US007522123B1

(12) United States Patent
Gou

(10) Patent No.: US 7,522,123 B1
(45) Date of Patent: Apr. 21, 2009

(54) COLLAPSIBLE ANTENNA EQUIPPED WITH AN EXTERNAL ADAPTER

(76) Inventor: Pony Gou, P.O. Box 166-13, Taipei (TW) 115

( * ) Notice: Subject to any disclaimer, the term of this patent is extended or adjusted under 35 U.S.C. 154(b) by 1 day.

(21) Appl. No.: 11/907,538

(22) Filed: Oct. 15, 2007

(51) Int. Cl.
*H01Q 1/10* (2006.01)

(52) U.S. Cl. ..... 343/901; 343/702; 343/900

(58) Field of Classification Search ..... 343/702, 343/900, 901
See application file for complete search history.

(56) References Cited

U.S. PATENT DOCUMENTS 6,075,489 A * 6/2000 Sullivan ..... 343/702
6,249,257 B1 * 6/2001 Powles et al. ..... 343/702

* cited by examiner

*Primary Examiner*—Anh Q Tran

(57) ABSTRACT

A collapsible antenna extends round the circumference, further equipped with an external adapter comprising an antenna base (2) fixed to an electronic device (4) for signal transmission. An antenna body (1) slidly moved with respect to the antenna base (2) is in contact with the antenna base (2) having a stopper end at a proximal end shielded by the antenna base (2), but a free end at a distal end adapted to an external adapter. A plug (50) of an external antenna (5) received in the external adapter, after the antenna body (1) retracts into the antenna base (2), the external adapter (3) is in contact with the antenna base (2). Signal transmission from the external adapter (3) to the antenna base (2) is therefore instead of the same from the antenna body to the antenna base.

8 Claims, 12 Drawing Sheets

COLLAPSIBLE ANTENNA EQUIPPED WITH AN EXTERNAL ADAPTER

FIELD OF THE INVENTION

This present invention related to a collapsible antenna equipped with external adapter.

BACKGROUND OF THE INVENTION

Today's advanced miniature wireless communication devices are equipped with miniature antennas. To broaden frequency band width of communication channel, not only the selected antenna frequency is therefore gradually broadened than ever, but also high frequency (HF) radio frequency (RF) communication channels are shared by the advanced miniature communication devices. For example, Bluetooth protocol is implemented to a various products requires a broad bandwidth in the 2.4 GHz band, while users of global system for mobile communications (GSM) roam requires 1.8 GHz band, but applications for wireless local area network (WLAN) can be selectively worked with the release of standard 2.4 GHz and faster 5.2 GHz dual band.

Conventional laptop computers are usually equipped with built-in antennas to process 2.4 GHz signals connected to internet due to a limited inner space, but it could not process 5.2 GHz signals connected to cable television. External antennas are necessitated to provide dual band signal strength. At the same time, personal digital assistant (PDA), palm television services (Palm TV) are also added with external antennas for connecting to cable television.

As shown in FIG. 1, a rear end of a conventional electronic device (4) (i.e. laptop computer) are equipped with two signal sockets (41, 42), one is a standard band signal socket (41) accessing for a first channel (for example, 2.4 GHz band), the other is a broad band signal socket (42) accessing for a second channel (for example, 5.2 GHz band). The standard band signal socket (41) is connected to a wireless antenna (6) for transmitting and receiving wireless signals to the electronic device (4) accessing for the internet. The broad band signal socket (42) is connected to a plug (50) of an external antenna (5) for transmitting visual signals to the electronic device (4) accessing for the cable television (TV). When the wireless antenna (6) is applied for transmitting data on line, the external antenna (5) is out of use. Conversely, when the external antenna (5) is applied for transmitting cable TV signals, the wireless antenna (6) is out of use.

Or the electronic device (4) has a built-in antenna accessing for the internet as the first channel; while the plug (50) of the external antenna (5) fits into the signal socket (42) accessing for the cable TV instead, or the plug (50) idly draws out of the signal socket (42) on the rear end of the electronic device (4).

Since rear end of the conventional electronic device (4) is custom prefabricated with two signal sockets (41, 42) accessing for dual channel, the limited inner space is crowded to accommodate two signal sockets (41, 42). It may cause signals crosstalk etc. Therefore, if two signal sockets can be integrally incorporated into only one signal socket, further dual channel being provided therewith invoke aid of a compact design with improving space utilization for the electronic device.

Furthermore, a built-in antenna as well as an external antenna (5) incorporated into the conventional electronic device (4) may fail to match selected frequency but weaken signal strength due to they are crowded inside the limited inner space of the electronic device (4). The present invention is to provide a collapsible antenna added with external adapter to improve the problems as mentioned above.

SUMMARY OF THE INVENTION

The invention is to provide a collapsible antenna, an external adapter added thereto is to connect to an outer antenna; further the collapsible antenna can extend round circumference for implementation of dual channel communication.

Point against aforesaid problems, the invention is to provide a collapsible antenna equipped with an external adapter characterized in that:

An antenna base (2) coupled to an electronic device (4) transmitting signals to the electronic device (4);

An antenna body (1) extends round circumference from the antenna base (2) to form a first conductive path accessing for a first channel; a proximal end of the antenna body (1) has a stopper end (1*a*) fit in the antenna base (2), a distal end of the antenna body (1) is a free end (1*b*); and An external adapter (3) fits over the free end (1*b*) of the antenna body (1), the external adapter (3) is insulated against the free end (1*b*) and the antenna body (1); the external adapter (3) accommodates a plug (50) of an external antenna base (5) to fit in to form a second conductive path accessing for a second channel;

Wherein the antenna body (1) retracted into the antenna base (2), the first conductive path between the antenna body (1) and the antenna base (2) is out of use, signals of the first channel are interrupted; while the external adapter (3) is connected to the antenna base (2) to form the second conductive path instead, signals of the second channel are transmitted to the antenna base (2) by the external adapter (3).

A collapsible antenna equipped with an external adapter as mentioned wherein the antenna body (1) consists of a first conductive tube (10), at least a second conductive tube (11), a third conductive tube (12); the stopper end (1*a*) is disposed to a proximal end of the third conductive tube (12), and the free end (1*b*) is disposed to a distal end of the first conductive tube (10); wherein an outer diameter of the first conductive tube (10) is smaller than an inner diameter of an innermost second conductive tube (11), and an outer diameter of an outermost second conductive tube (11) is smaller than an inner diameter of the third tube (12); whereby, each two adjacent tubes are slidably moved with respect to each other and received in the antenna base (2).

A collapsible antenna equipped with an external adapter as mentioned wherein the antenna base (2) consists of a signal base (23) at a proximal end fixed to the electronic device (4); a first ground gasket (20) at a distal end of the antenna base (2) is out of contact with the signal base (23); an insulator ring (21) disposed between the first ground gasket (20) and the signal base (23); a rolled claw (22) disposed at a proximal end inside the signal base (23) is in contact with the antenna body (1) to conduct signals; and an insulated stopper ring (24) disposed to a proximal end of the signal base (23) is in contact with the antenna body (1).

A collapsible antenna equipped with an external adapter as mentioned wherein the external adapter (3) consists of a cylindrical signal socket (33) having a center protruding tube (331) sticking out at a distal end, an insulator collar (32) fits over the center protruding tube (331), a second ground gasket (31) fits over the insulator collar (32); the second ground gasket (31) is out of contact with the signal socket (33); and an insulator cap (34) disposed inside the cylindrical signal gasket (33) fits over the free end of the antenna body (1); the signal socket (33) is in contact with the rolled claw (22) of the antenna base (2) for signal transmission.

A collapsible antenna equipped with an external adapter as mentioned wherein a dust proof cap (30) disposed to a distal end of the second ground gasket (31) sealing an open end of the second ground gasket (31).

A collapsible antenna equipped with an external adapter as mentioned wherein the dust proof cap (30) is connected to the second ground gasket (31) by a drop-off-proof slip (302), a proximal end of the drop-off-proof slip (302) has a small support loop (301) wraps around the second ground gasket (31).

A collapsible antenna equipped with an external adapter as mentioned wherein outer threads formed on an outer side peripheral of the second ground gasket (31) is screwed to the first ground gasket (20), where inner threads (201) formed on an inner hole of the first ground gasket (20).

A collapsible antenna equipped with an external adapter as mentioned wherein the antenna body (1) has a foldable joint (13) disposed close the stopper end (1*a*) of the antenna body (1).

DETAILED DESCRIPTION OF EMBODIMENTS

Detailed description of the embodiments is described according to the appended drawings hereinafter.

Figure 1:
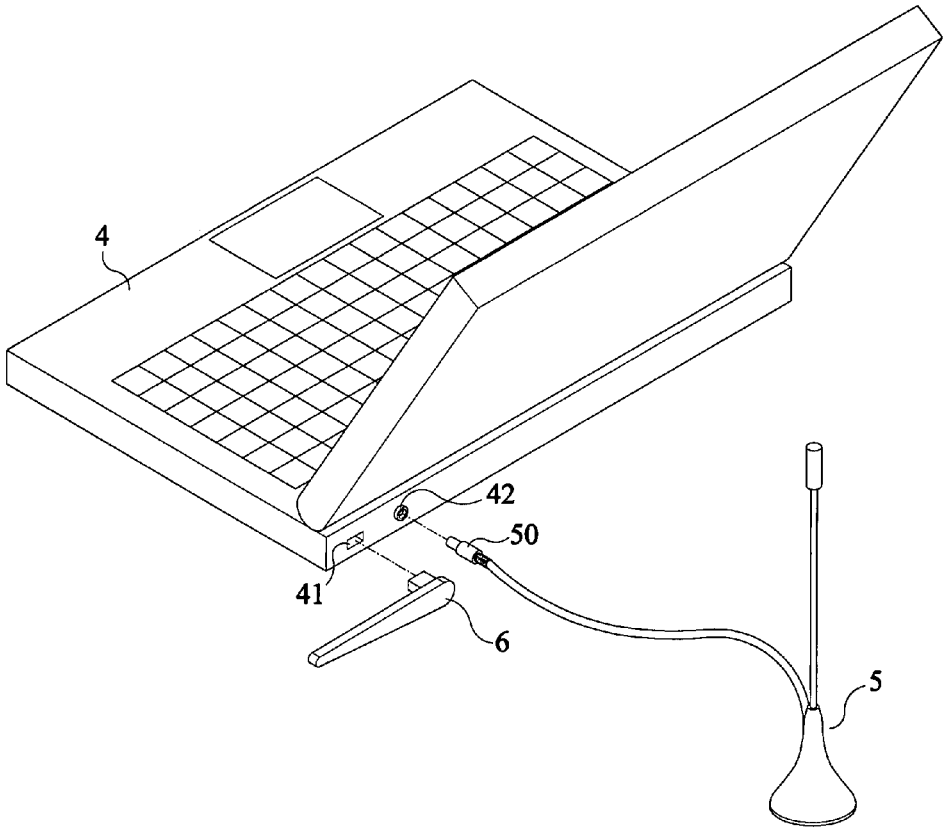
Prior art FIG.1
FIG. 1: is a schematic view of a conventional external antenna connected to a laptop computer.
Figure 2:
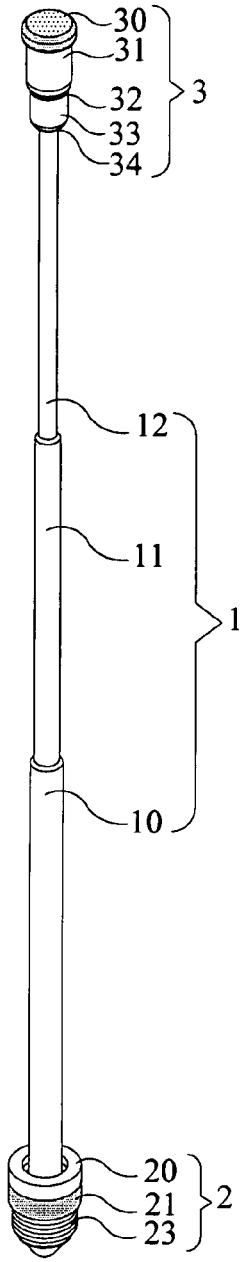
FIG. 2: is a perspective view of the antenna body with external adapter fully extended.
Figure 3:
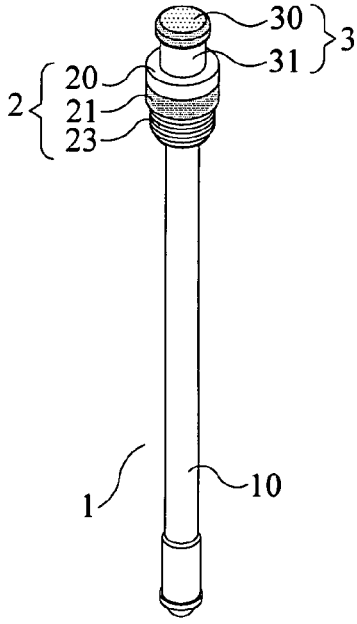
FIG. 3: is a perspective view of the antenna body with external adapter fully retracted.
Figure 4:
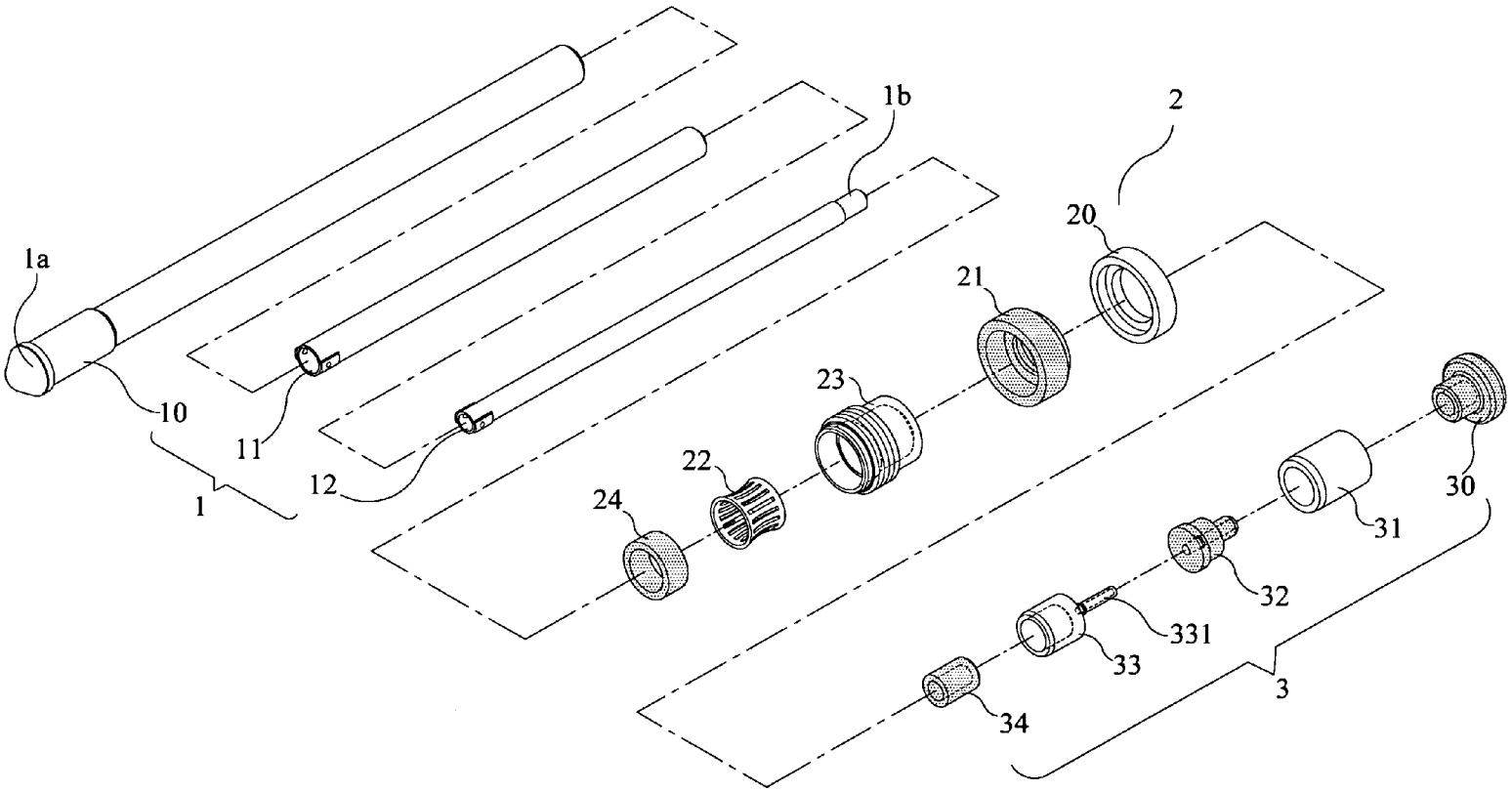
FIG. 4: is an exploded view of the antenna body with external adapter.

As shown in FIGS. 2~4, a collapsible antenna equipped with an external adapter is illustrated. It includes an antenna base (2) fixed to an electronic device (4) further the antenna base (2) can transmit signals to the electronic device (4). An antenna body (1) is slidably moved with respect to the antenna base (2) to form a first conductive path between the antenna body and the antenna base. Signals of a first channel can be transmitted to the electronic device (4) by means of the antenna body (1) and the antenna base (2). The antenna body (1) has a stopper end (1*a*) at a proximal end to fit in the antenna base (2), and a free end (1*b*) at a distal end. An external adapter (3) fit over the free end (1*b*) is coupled to the free end (1*b*) but the external adapter (3) is out of contact with the free end (1*b*). In other words, the external adapter (3) is electrically insulated from the free end (1*b*). The external adapter (3) accommodates a plug (50) of an external antenna base (5) received therein for signals of a second channel transmitting to the electronic device (4) anytime. When the antenna body (1) is fully retracted into the antenna base (2), the antenna body (1) is out of contact with the antenna base (2), the first conductive path between the antenna body (1) and the antenna base (2) are severed. Signals of the first channel are interrupted from transmitting to the electronic device (4). Alternatively, the external adapter (3) is connected to the antenna base (2) to form a second conductive path between the external adapter and the antenna base instead. Signals of a second channel received by the external antenna (5) are therefore transmitted to the antenna base (2) via the external adapter (3).

The antenna body (1) consists of a first conductive tube (10); at least, a second conductive tube (11); and a third conductive tube (12). An outer diameter of the third conductive tube (12) is smaller than an inner diameter of an innermost second conductive tube (11), and an outer diameter of an outermost second conductive tube (11) is smaller than an inner diameter of the first conductive tube (10). Each two adjacent tubes of the first tube, the second tubes, and the third tube are slidly moved with respect to each other and received in the antenna base. However, the antenna body (1) can be formed as only a first conductive tube (10), or the antenna body (1) can be formed as a first conductive tube (10) plus a third conductive tube (12). Thereby, the antenna body (1) is not limited to a first, second, third conductive tubes (10, 11, 12) illustrated in FIG. 2, either one or two conductive tubes can be assembled together to form an antenna body (1).

The antenna base (2) consists of a signal base (23) fixed to the electronic device (4). A first ground gasket (20) disposed to a distal end of the signal base (23) is out of contact with the signal base (23) due to an insulator ring (21) is disposed between the first ground gasket (20) and the signal base (23). A rolled claw (22) made of metal leaf of a modified diabolo shape with longitudinal slots distributed over a circumferential surface disposed at a distal end inside the signal base (23) is in contact with the antenna body (1) to conduct signals; and a stopper ring (24) disposed to a proximal end of the signal base (23) is in contact with the antenna body (1).

The external adapter (3) consists of a cylindrical signal socket (33) having a center protruding tube (331) sticking out to a distal end, an insulator collar (32) fits over the center protruding tube (331), a second ground gasket (31) fits over the insulator collar (32) and the second ground gasket (31) is out of contact with the signal socket (33); and an insulator cap (34) disposed inside the cylindrical signal socket (33) fits over the free end of the antenna body (1); the signal socket (33) is in contact with the rolled claw (22) of the antenna base (2) for signal transmission.

Most plugs (50) of the external antenna base (5) available on the market are radio frequency (RF) high frequency (HF) terminator, said external adapter (3) also makes use of a radio frequency (RF) high frequency (HF) radio frequency (RF) terminator. Pairs of RFHF adapter and plug are easy to connect with each other. Next, an open end of the second ground gasket (31) is sealed by a dust proof cap (30) to avoid from muddy stains contaminated the projected tube (311).

Figure 5:
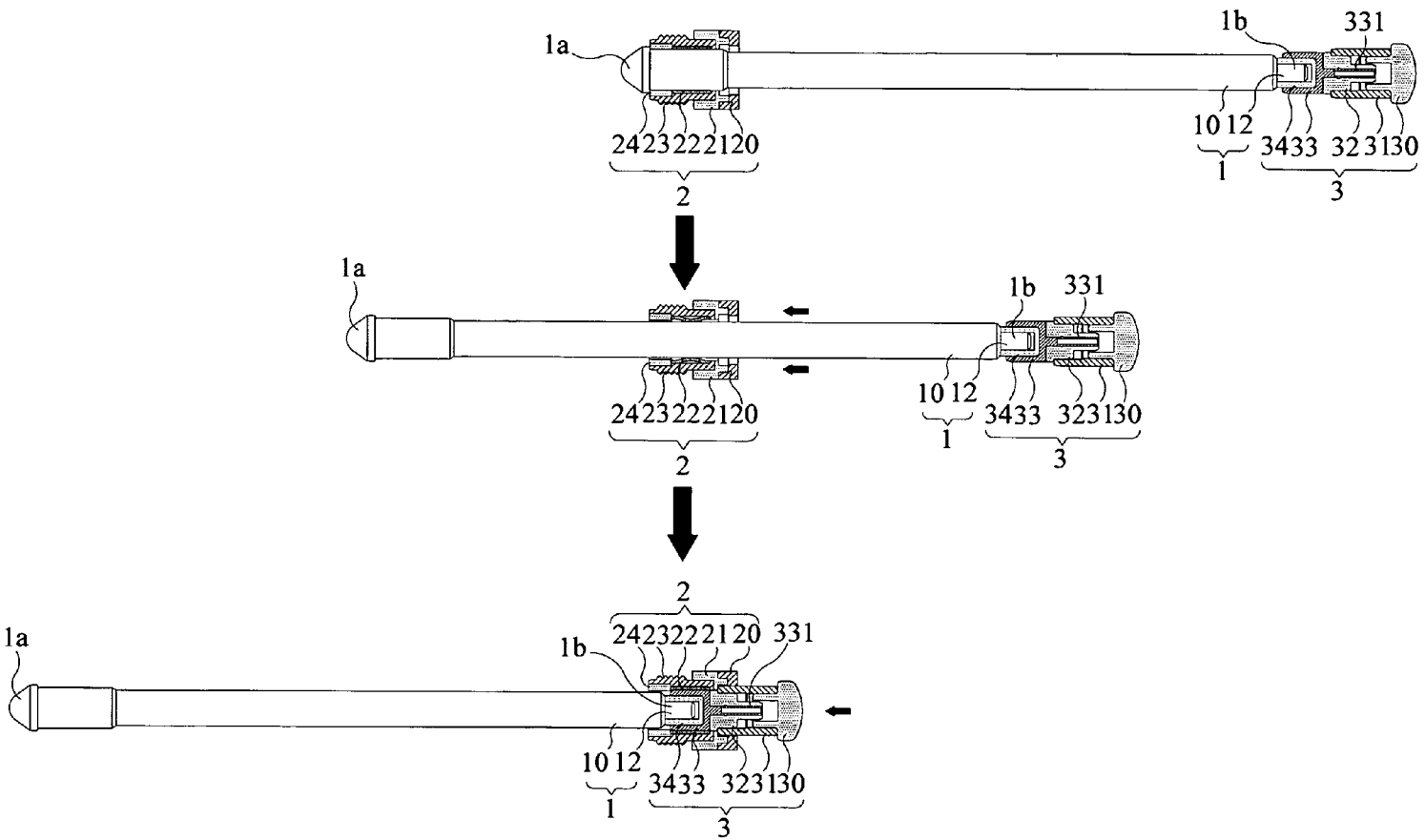
FIG. 5: is a schematic view of the antenna base slidably moved from the stopper end to the free end in a continuous action from top, middle, to bottom portions.
Figure 6A:
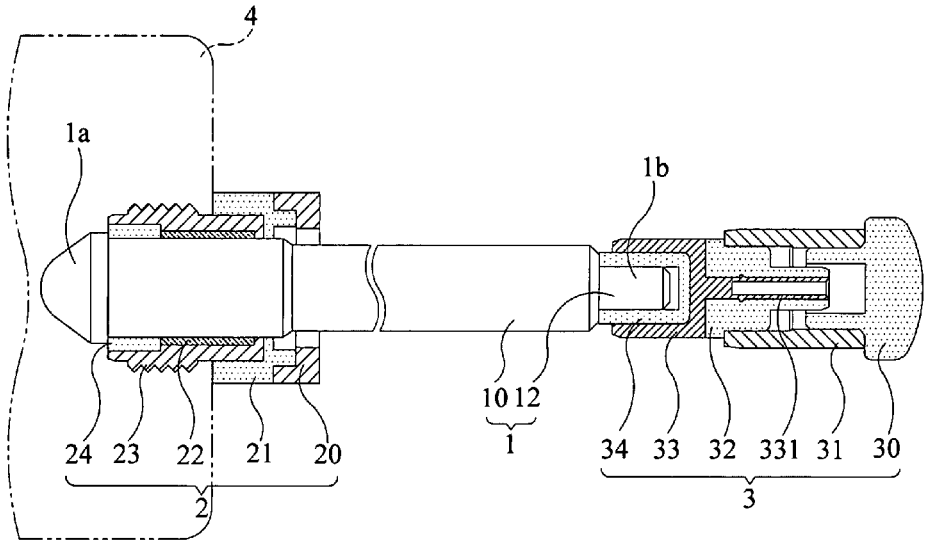
FIG. 6A: is a sectional view of the antenna base detached from the external adapter.
Figure 6B:
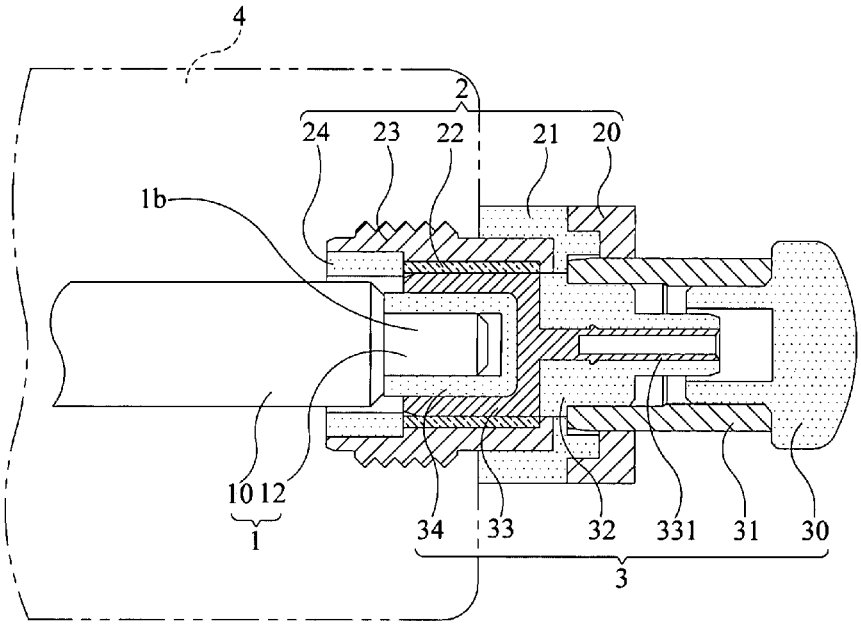
FIG. 6B: is a sectional view of the antenna base coupled to the external adapter.

The antenna base (2) is fixed to the electronic device (4), as shown in top portion of FIG. 5, the antenna body (1) is stretched out from the electronic device (4). (also see FIG. 6A) The first conductive tube (10) of the antenna body (1) is in contact with the rolled claw (22) of the antenna base (2). Signals of the first channel are transmitted through the antenna body (1), the rolled claw (22), and the signal base (23) to the electronic device (4). As shown in middle portion of FIG. 5, the antenna body (1) is retracting inside the electronic device (4); the first conductive tube (10) of the antenna body (1) is still kept in contact with the rolled claw (22) of the antenna base (2). Therefore, signals of the first channel are still interfered with the electronic device (4) by the antenna body (1) and the antenna base (2). As shown in bottom portion of FIG. 5, the antenna body (1) is fully retracted into the electronic device (4), (also see FIG. 6B) where the rolled claw (22) is detached from the antenna body (1); in turn, the rolled claw (22) is in contact with the signal socket (33) of the external adapter (3) instead. Signals of a second channel, if any, are transmitted to the electronic device (4) by means of the signal socket (33), the rolled claw (22) and the signal base (23).

Figure 7:
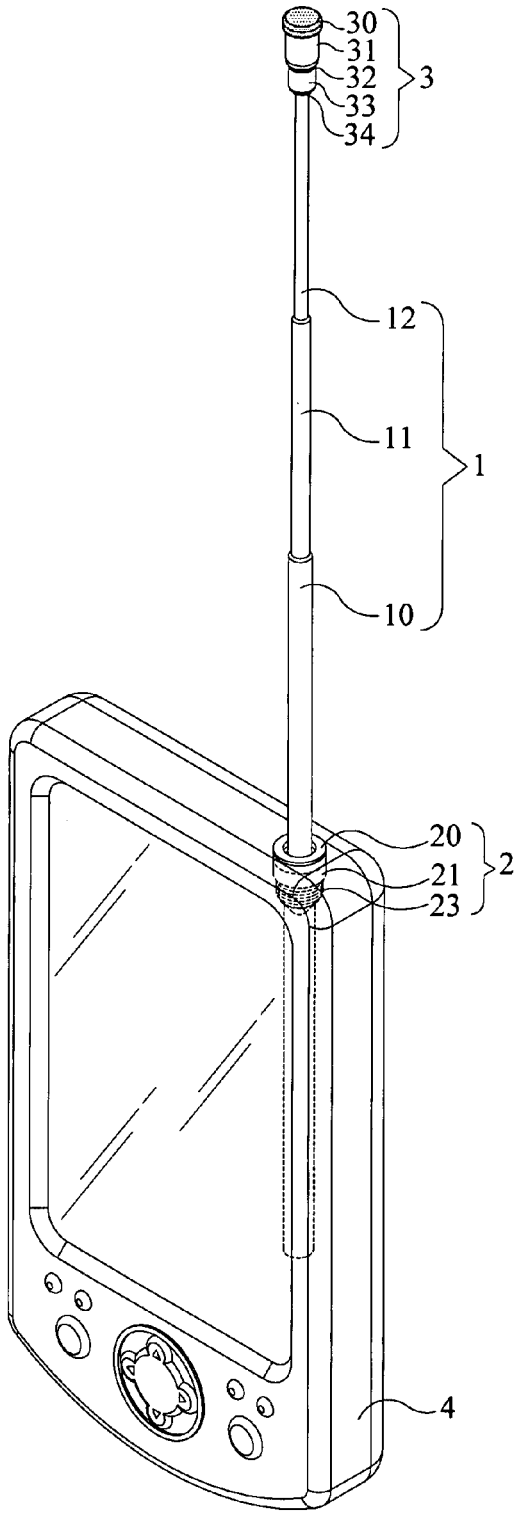
FIG. 7: is a schematic view of the antenna body fully extended during use.

As shown in FIG. 7, while using a personal digital assistant (PDA), an antenna body (1) is stretched from a fully retracted antenna to a fully extended antenna to receive signals of the first channel. After using, the antenna body (1) is fully retracted again. Moreover, an external adapter (3) is coupled to the free end of the antenna body (1), at that time, the external body still is not in application; an open end at a distal end of the external adapter (3) is sealed by a dust proof cap (30).

Figure 8:
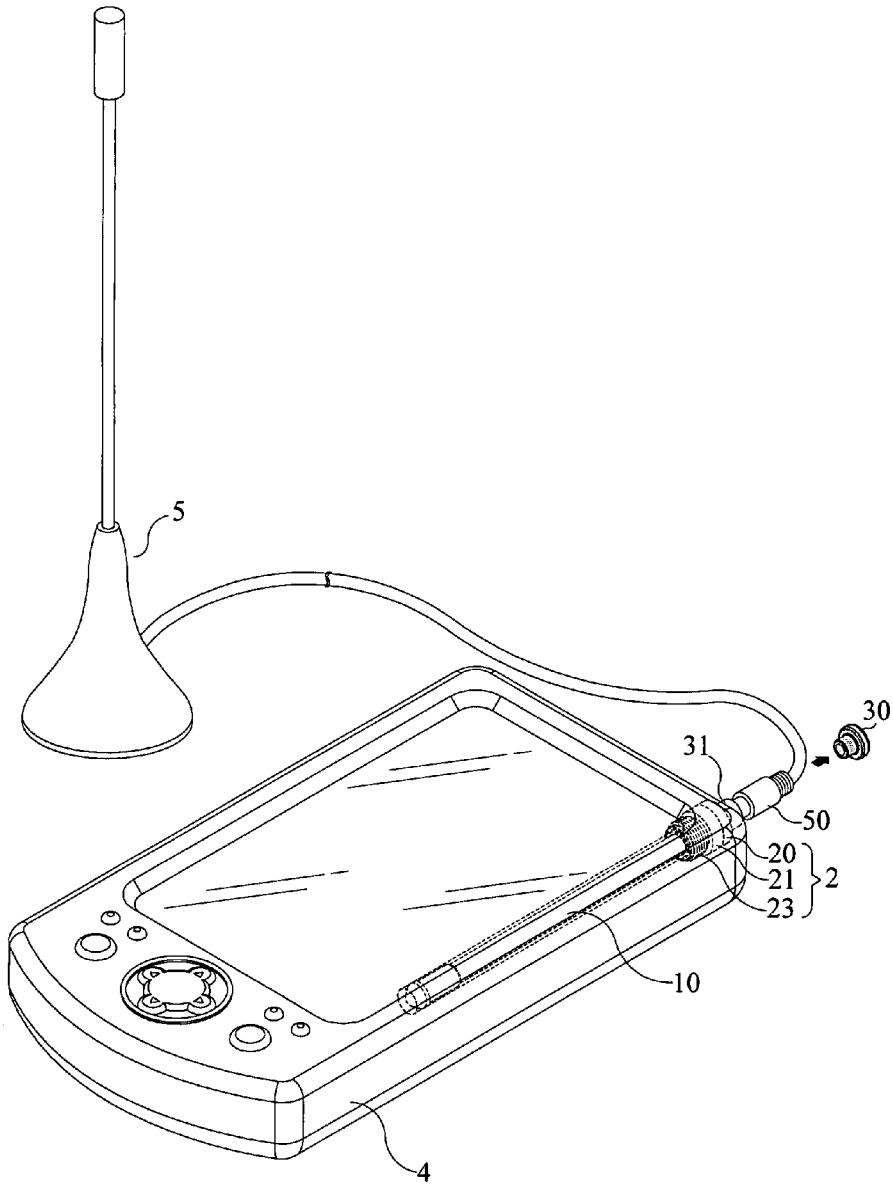
FIG. 8: is a schematic view of the antenna body fully retracted and an external adapter connected to an external antenna during use.
Figure 9:
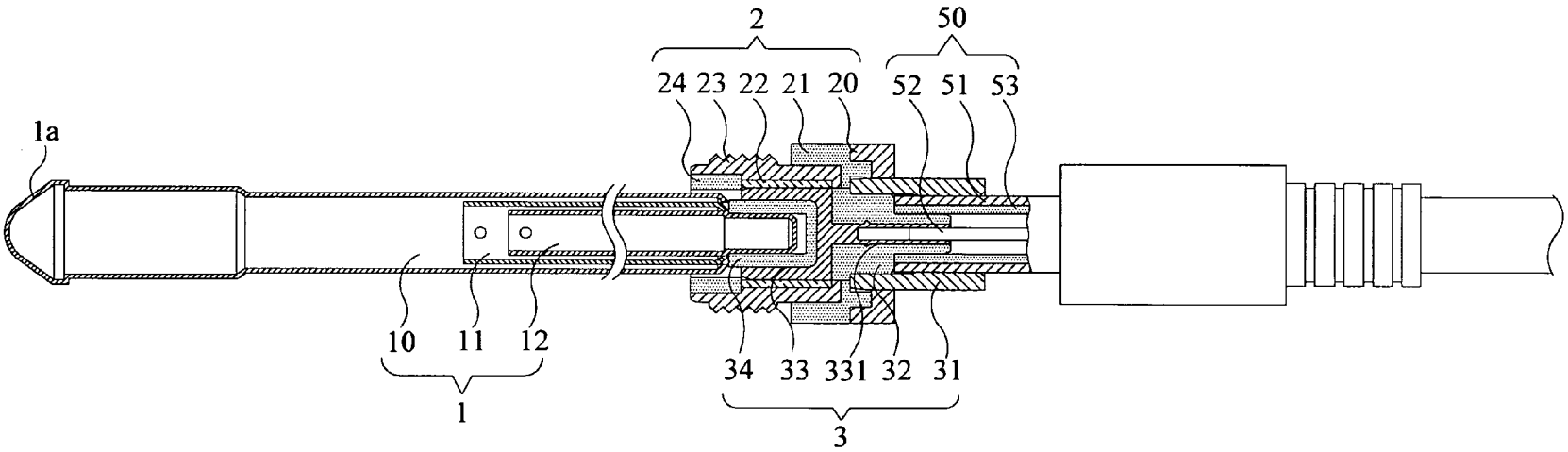
FIG. 9: is a sectional view of FIG. 7.

As shown in FIG. 8, when the electronic device (4) is requested for a high quality of communication, or weak signal strength can also be caused by destructive interference of the signals from local towers of urban areas, or by the construction materials used in some buildings causing rapid attenuation of signal strength etc. The antenna body (1) is necessitated to retract into the electronic device (4) instead of being stretched out. The dust proof cap (30) is, therefore, necessary to be detached from the distal end of the antenna body (1). Then the plug (50) of the external antenna base (5) is inserted into the external adapter (3). As shown in FIG. 9, the rolled claw (22) inside the antenna base (2) is out of contact with the antenna body (1) whereby signals of the first channel are interrupted. In turn, the rolled claw (22) is alternatively in contact with the signal socket (33) of the external adapter (3), thereby, the antenna body (1) is operated in coordination with the antenna base (2). Plug (50) is equipped with a center signal terminator (52) sticking out at a proximal end. The signal terminator (52) inserts into the center protruding tube (331) of the signal socket (33). A ground sleeve (51) formed around a circumferential surface of the plug (50) is coupled to the second ground gasket (31). An insulated layer (53) formed on an inner side of the ground sleeve (51) is coupled to a tapered distal end of the insulator collar (32). Therefore, signals of the second channel received by the external antenna base (5) can be transmitted to the electronic device (4) by the signal terminator (51), the signal socket (33), the rolled claw (22), and the signal base (23).

Because the antenna base (2) could not simultaneously receive signals from both the first and second channels, there is no problem incurred about inferior communication arises, but prevents interfering with signal transmission.

Figure 10A:
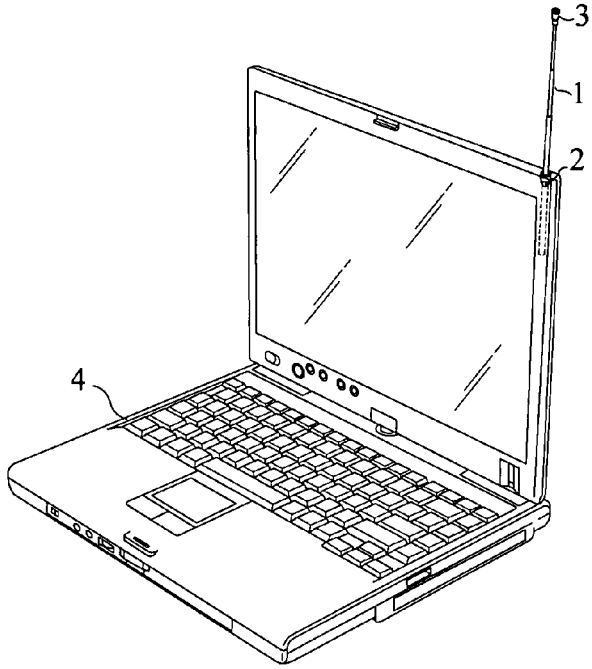
FIGS. 10A~10C: are schematic views of the antenna body fully extended connected to a laptop computer.
Figure 10B:
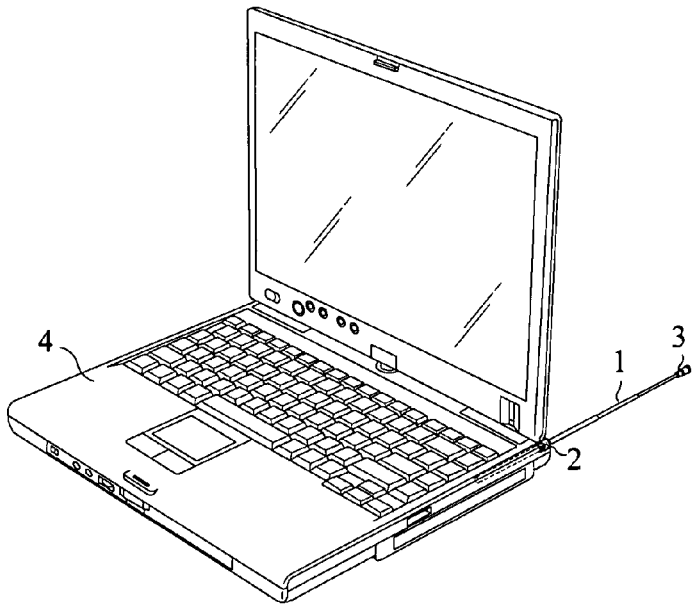
Figure 10C:
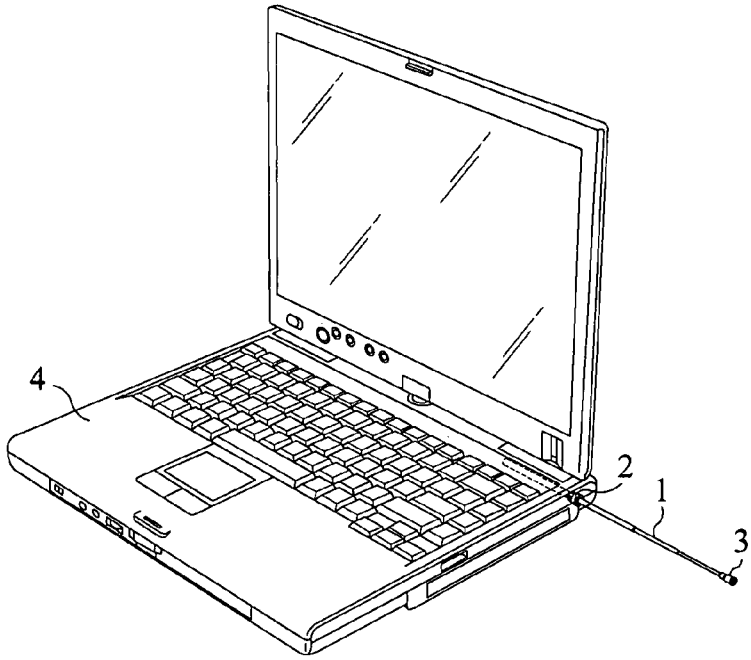
Figure 11:
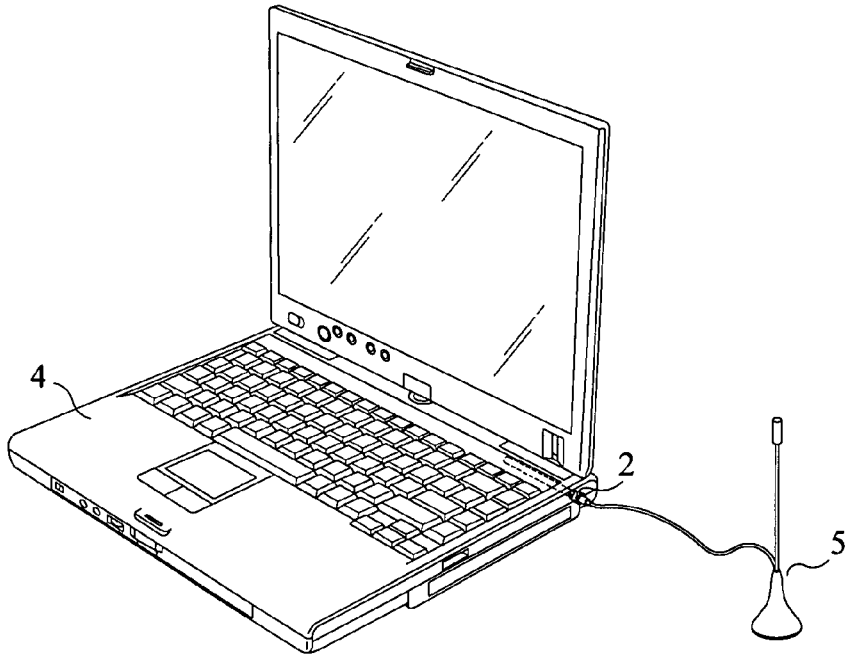
FIG. 11: is a schematic view of the external antenna connected to a laptop computer.

As shown in FIGS. 10A~10C and 11, a laptop computer (4) is equipped with a collapsible antenna, which is designed according to demands of manufacturers and users but limited by a narrow space inside the laptop computer. The collapsible antenna can be installed to different locations, further can extend round circumference to facilitate accessing internet rapidly for users. As shown in FIG. 10A, an antenna is longitudinally extended from a top right end of a monitor of laptop computer. As shown in FIG. 10B, an antenna is longitudinally extended from a right rear end of a housing of laptop computer. As shown in FIG. 10C, an antenna is transversally extended from a right rear end of a housing of laptop computer. No matter wherever an antenna is extended from laptop computer, the antenna is extended to receive signals of the first channel. Augmented signal strength of the extended antenna is clear than conventional built-in antenna, further being provided with better quality of communication. As shown in FIG. 11, the external adapter (3) can be connected to an external antenna (5); even a wireless wide local area network (WLAN) card can be omitted. Cable kits and a slot space can be saved from peripherals of laptop computer, which is more flexible and convenient for users.

As shown in FIG. 11, an extendable antenna is retracted into laptop computer hidden from view. Only an antenna base (3) or an external adapter (3) connected to the antenna base (3) is exposed out of a lateral side of laptop computer. When a plug (50) of the external antenna base (5) is inserted into the external adapter (3), signals of the second channel can be transmitted to the laptop computer.

Figure 12:
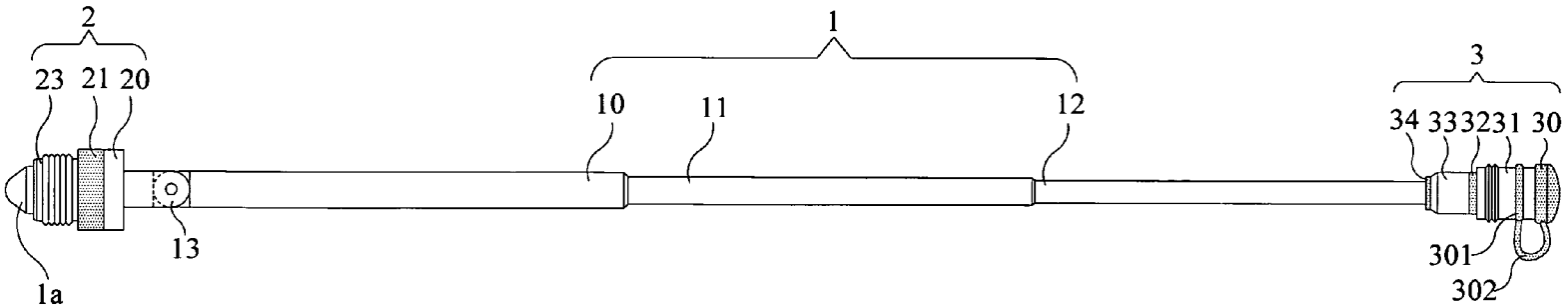
FIG. 12: is a schematic view of another embodiment of the collapsible antenna.

As shown in FIG. 12, an extended antenna provided to the laptop computer is illustrated. In which, a drop off proof slip (302) is added to the dust proof cap (30), which is disposed to a distal end of the external adapter (3). A small support loop (301) made from, for example, shielded wire wraps around the antenna body (1) at a proximal end of the drop off proof slip (302). As a result, even the dust proof cap (30) is thrown open and detached from the external adapter (3), the dust proof cap (30) is still suspended from the antenna body (1). The dust proof cap (30) can be restored to cap over the external adapter (3).

Figure 13:
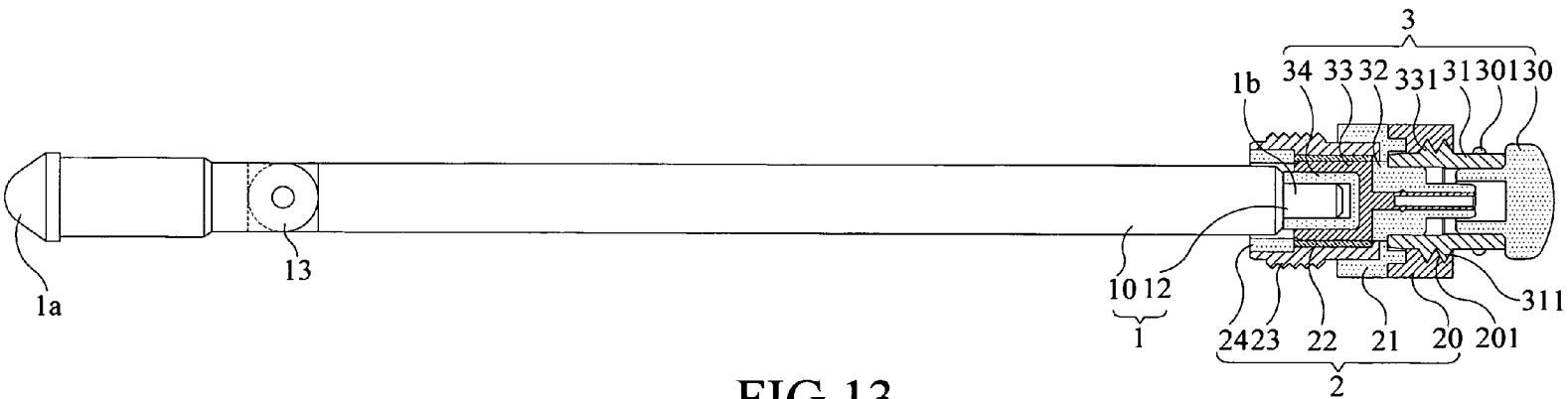
FIG. 13: is a schematic view of anther embodiment of the collapsible antenna.

As shown in FIG. 13, outer threads formed on an outer side periphery of the second ground gasket (31) can be screwed to the first ground gasket (20), where inner threads (201) formed on an inner hole of the first ground gasket (20).

Thereby, when the plug (50) of the antenna base (5) is drawn out of the external adapter (3), the antenna body (1) will not get loose further to weaken signal strength, and the antenna body (1) is not drawn out by the same operation.

Figure 14:
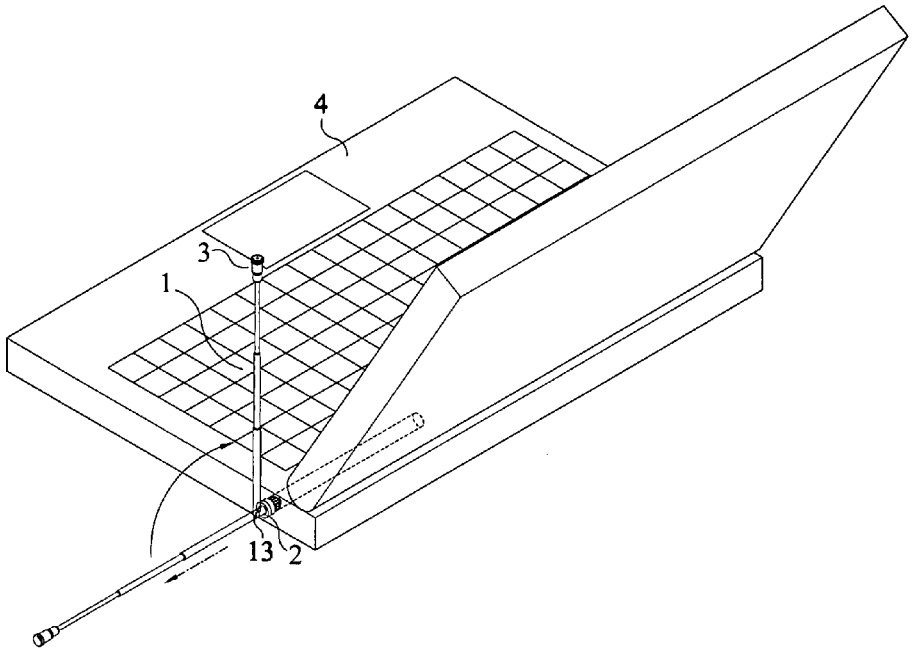
FIG. 14: is a schematic view of the collapsible antenna can extend round circumference.

As shown in FIG. 14, the collapsible antenna of the invention is designed with a folding capacity, (also see FIG. 12) as a flexible joint (13) is disposed close the stopper end (1*a*) with a folding capacity. When the antenna body (1) is stretched out from the electronic device (4), the collapsible antenna (1) can extend round circumference to alter angles for receiving signals. Furthermore, the antenna body (1) is designed as circular tubes, thereby, the tubes can extend round circumference (360°). Accordingly, the antenna body (1) can be adjusted with an angle from front to rear or from left to right etc., for clearly receiving signals.

ADVANTAGES OF EMBODIMENTS OF THE INVENTION

When the antenna body (1) is stretched out from the electronic device (4) to form a first conductive path between the antenna body (1) and the antenna base (2) accessing for a first channel, whose signals can be transmitted to the electronic device (4) by the antenna body (1), and the antenna base (2). While the antenna body (1) is fully retracted into the electronic device (4), the antenna body (1) is out of contact with the antenna base (2). Signals of the first channel are interrupted. As a free end of the antenna body (1) is connected to an external adapter (3) to form a second conductive path (instead of the first conductive path); the external adapter (3) accommodates a plug (50) of conventional antenna base (5) received therein. Signals of the second channel antenna body (1) are transmitted through the plug (50), the external adapter (3) and the antenna base (2) to the electronic device (4). For example, "interactive television" or "internet protocol television (IPTV)", internet etc., can be listed as in the categories of "second" and "first" channels respectively, when signals transmitted to the electronic device, it is understood that, at least, some responsive signals can also be received from the electronic device.

The antenna base (2) is fixed to the electronic device (4) by a rolled claw (22). Since the antenna body (1) is composed of at least one section or more than two sections of collapsible tubes; which are slidly moved with respect to each two adjacent tubes and received in the antenna base (2), and the rolled claw (22) is in contact with the antenna body (1). Signals of the first channel are transmitted to and received from the electronic device (4) by the signal base (23) in contact with the rolled claw (22). But when the antenna body (1) is fully retracted into the electronic device (4), the rolled claw (22) is detached from the antenna body (1); in turn, the rolled claw (22) is alternatively in contact with the signal socket (33) of the external adapter (3). Signals of the second channel are transferred through the signal socket (33), the rolled claw (22) and the signal base (23) to the electronic device (4). Signals of the first, second channels can be alternatively transmitted to the electronic device without interfering with each other. Quality of communication can be kept.

The antenna body (1) is a collapsible tube; length of the antenna body (1) is therefore to be elongated. Signal strength of the antenna body (1) can be augmented than conventional short antenna or built-in antenna.

The dust proof cap (30) can be used to prevent muddy stains formed inside the second ground gasket (31), while the drop-off-slip (302) is designed to attach the dust proof cap (30) about the distal end of the antenna body (1) by the small support loop made from, for example, shielded wire, the support loop is sufficiently rigid to suspend the dust proof cap (30) detached from the antenna body (1) not to be lost.

Outer threads (311) formed on an outer side peripheral of the second ground gasket (31) can be screwed to inner threads (201) formed on an inner hole of the first ground gasket (20). Thereby, when the plug (50) of the antenna base (5) is drawn out of the external adapter (3), the collapsible antenna (1) will not get loose, further signal strength can be maintained. The collapsible antenna (1) could not be drawn out accompanied by the external adapter (3).

What is claim claimed:

1. A collapsible antenna equipped with an external adapter characterized in that:

an antenna base (2) coupled to an electronic device (4) transmitting signals to the electronic device (4);

an antenna body (1) extends round circumference from the antenna base (2) to form a first conductive path accessing for a first channel; a proximal end of the antenna body (1) has a stopper end (1*a*) fit in the antenna base (2), a distal end of the antenna body (1) is a free end (1*b*); and an external adapter (3) fits over the free end (1*b*) of the antenna body (1), the external adapter (3) is electrically insulated from the free end (1*b*) and the antenna body (1); the external adapter (3) accommodates a plug (50) of an external antenna base (5) to fit in to form a second conductive path accessing for a second channel;

wherein the antenna body (1) retracted into the antenna base (2), the first conductive path between the antenna body (1) and the antenna base (2) is severed, signals of the first channel are interrupted; while the external adapter (3) is connected to the antenna base (2) to form the second conductive path instead, signals of the second channel are transmitted to the antenna base (2) by the external adapter (3).

2. A collapsible antenna equipped with an external adapter as claim 1 claimed wherein the antenna body (1) consists of a first conductive tube (10), a third conductive tube (12) and, at least, a second conductive tube (11); the stopper end (1*a*) is disposed to a proximal end of the third conductive tube (12), and the free end (1*b*) is disposed to a distal end of the first conductive tube (10); wherein an outer diameter of the first conductive tube (10) is smaller than an inner diameter of an innermost second conductive tube (11), and an outer diameter of an outermost second conductive tube (11) is smaller than an inner diameter of the third tube (12); whereby, each two adjacent tubes are slidably moved with respect to each other and received in the antenna base (2).

3. A collapsible antenna equipped with an external adapter as claim 2 claimed wherein the antenna base (2) consists of a signal base (23) at a proximal end fixed to the electronic device (4); a first ground gasket (20) at a distal end of the antenna base (2) is out of contact with the signal base (23); an insulator ring (21) disposed between the first ground gasket (20) and the signal base (23); a rolled claw (22) made of metal leaf of a modified diabolo shape with longitudinal slots distributed over a circumferential surface disposed at a proximal end inside the signal base (23) is in contact with the antenna body (1) to conduct signals; and an insulated stopper ring (24) disposed to a proximal end of the signal base (23) is in contact with the antenna body (1).

4. A collapsible antenna equipped with an external adapter as claim 3 claimed wherein the external adapter (3) consists of a cylindrical signal socket (33) having a center protruding tube (331) formed with internal axial channel sticking out at a distal end, an insulator collar (32) fits over the center protruding tube (331), a second ground gasket (31) fits over the insulator collar (32), the second ground gasket (31) is out of contact with the signal socket (33); and an insulator cap (34) disposed inside the cylindrical signal gasket (33) fits over the free end of the antenna body (1); the signal socket (33) is in contact with the rolled claw (22) of the antenna base (2) for signal transmission.

5. A collapsible antenna equipped with an external adapter as claim 4 claimed wherein a dust proof cap (30) disposed to a distal end of the second ground gasket (31) sealing an open end of the second ground gasket (31).

6. A collapsible antenna equipped with an external adapter as claim 5 claimed wherein the dust proof cap (30) is connected to the second ground gasket (31) by a drop-off-proof slip (302), a proximal end of the drop-off-proof slip (302) has a small support loop (301) wraps around the second ground gasket (31).

7. A collapsible antenna equipped with an external adapter as claim 4 claimed wherein outer threads formed on an outer side peripheral of the second ground gasket (31) is screwed to the first ground gasket (20), where inner threads (201) formed on an inner hole of the first ground gasket (20).

8. A collapsible antenna equipped with an external adapter as claim 1 claimed wherein the antenna body (1) has a foldable joint (13) disposed close the stopper end (1*a*) of the antenna body (1).

* * * * *